US006314586B1

(12) United States Patent
Duguid

(10) Patent No.: US 6,314,586 B1
(45) Date of Patent: Nov. 13, 2001

(54) SUPPLEMENTAL PROTECTIVE PAD FOR A SPORTS HELMET

(76) Inventor: John R. Duguid, 9610 N. CR 1025 East, Brownsburg, IN (US) 46112

( * ) Notice: Subject to any disclaimer, the term of this patent is extended or adjusted under 35 U.S.C. 154(b) by 0 days.

(21) Appl. No.: 09/695,182

(22) Filed: Oct. 24, 2000

(51) Int. Cl.[7] ..... A42B 3/00
(52) U.S. Cl. ..... 2/411; 2/422; 2/425; 2/455
(58) Field of Search ..... 2/411, 412, 425, 2/422, 455

(56) References Cited

U.S. PATENT DOCUMENTS

| | | | | |
|---|---|---|---|---|
| 3,815,152 | | 6/1974 | Bednarczuk et al . | |
| 3,877,076 | * | 4/1975 | Summers et al. | 2/414 |
| 4,223,409 | | 9/1980 | Lee | 2/411 |
| 4,307,471 | | 12/1981 | Lovell . | |
| 4,326,303 | | 4/1982 | Rappleyea | 2/411 |
| 4,512,037 | | 4/1985 | Vacanti . | |
| 4,724,549 | | 2/1988 | Herder et al. . | |
| 4,937,888 | | 7/1990 | Straus | 2/411 |
| 4,972,527 | | 11/1990 | Wallace . | |
| 5,068,922 | | 12/1991 | Zahn . | |
| 5,204,998 | | 4/1993 | Liu . | |
| 5,581,818 | | 12/1996 | Lorenzi et al. | 2/411 |
| 5,671,478 | | 9/1997 | Yen . | |
| 5,713,082 | | 2/1998 | Bassete et al. | 2/412 |
| 5,724,681 | | 3/1998 | Sykes | 2/425 |
| 5,940,890 | | 8/1999 | Dallas et al. . | |
| 5,953,762 | | 9/1999 | Corbett | 2/425 |
| 5,956,777 | | 9/1999 | Popovich | 2/424 |
| 6,093,468 | | 7/2000 | Toms et al. . | |

FOREIGN PATENT DOCUMENTS

| | | |
|---|---|---|
| 3314924-A1 | 9/1984 | (DE) . |
| 48442-A1 | 3/1982 | (EP) . |

* cited by examiner

*Primary Examiner*—Rodney M. Lindsey
(74) *Attorney, Agent, or Firm*—Woodard, Emhardt, Naughton Moriarty & McNett

(57) ABSTRACT

According to one embodiment of the present invention, an improved supplemental protective pad for a helmet is disclosed. In one embodiment, the pad includes a base portion which is mounted to the surface of a helmet shell. The pad is shaped to cover high risk, non-frontal impact areas such as the back of the head and adjacent the sides of the crown of the head. Extending outwardly from the pad are a plurality of compressible and crushable protrusions. The protrusions can be configured in a variety of shapes, sizes and densities to absorb a predetermined amount of force. When the individual wearing the helmet is involved in an impact on one of the impact areas, the protrusions complement any interior cushioning to compressibly absorb the impact force. If the impact force exceeds a predetermined level, the protrusions absorb additional energy while being crushably deformed. When the protective pad has been crushably deformed, preferably the crushed portion is visibly noticeable and the protective pad is replaced.

20 Claims, 8 Drawing Sheets

SUPPLEMENTAL PROTECTIVE PAD FOR A SPORTS HELMET

FIELD OF THE INVENTION

The present invention relates generally to the field of protection when using a helmet, and more particularly to the field of supplemental rear and side impact pads for a sports helmet used for activities such as football or hockey.

BACKGROUND OF THE INVENTION

As a safety measure, athletes involved in many types of sports, such as football and hockey, typically wear protective gear such as helmets to avoid injuries. Typical helmets are designed and structured to protect the athlete's head from a head-on frontal or top collision but are not designed to protect stresses on the brain. These helmets typically include a cushioning layer of material within the helmet shell which is held between the athlete's head and the helmet shell to absorb at least some of the impact force.

Although such equipment typically functions as designed for head-on or frontal impacts which the user often expects and can brace for, the equipment is not ideally structured to protect the brain from impact forces when the athlete is knocked directly backwards or sideways onto the rear or crown of the head and has no ability to brace for or cushion the fall. Recently, there have been a number of well publicized injuries to amateur and professional athletes in sports such as football and hockey where the individual may be tackled or checked and forced to fall straight back or sideways, thus directly impacting the back or side of the head. Accordingly, there is a need for an improved protective helmet which protects the brain from injury caused by impact at non-frontal angles such as backwards or adjacent to the top of the head.

When an individual is knocked backwards or sideways the fall is typically not cushioned resulting in direct impact on the helmet, which force is translated to the person's head. In such a direct impact the brain suffers an abrupt deceleration from its falling momentum and may suffer from inertial loading within the person's skull leading to linear or rotational compression and shear. One method of rating such impact force as a function of deceleration and time is called the Head Injury Criterion (HIC). It is believed that HIC values over 1,000 typically represent the onset of moderate to severe brain injury and HIC values between about 850–1000 can result in a mild brain injury such as a concussion. HIC levels below about 700 are not severe enough to cause mild brain injury. One discussion of the mechanics of head injury and the HIC is provided in, Elson, Lawrence M., Ph.D. and Ward, Carley C., Ph.D., "Mechanisms and Pathophysiology of Mild Head Injury,"*Seminars In Neurology,* March 1994: p.8–18.

One suggestion in prior helmets has been a cushion or pad within a helmet shell or on the exterior, protecting the top or front of the helmet. These pads are made from compressed fabric, rubber, sponges or rigid Styrofoam® multicellular material permanently mounted to the shell. The pads are intended to be used for the life of the helmet. The thicker the pad the better the absorption; however, to avoid an oversized helmet and/or discomfort to the user, the size of such pads is limited. In standard hockey or football helmets vinyl nitrile is used, whereas in bicycle helmets solid Styrofoam® material with sponge rubber is used.

When interior pads absorb an impact force they are compressed. The pads typically spring back into place; however, the material is worn with each such impact and over time the absorption power deteriorates. This deterioration is difficult to notice visually, especially when the material is inside of the helmet or a fabric cover. Once deterioration occurs, the helmet does not provide the protection originally intended.

An alternate teaching has been to mount a compressible material over the exterior of a helmet, such as described in U.S. Pat. No. 4,937,888 to Strauss. Although this provides a thicker combination of padding, the material still transmits the impact force after the material is completely compressed. Deterioration in the impact absorption ability of such a material is also difficult to observe visually. Further, the material thickness described in the Straus patent is primarily situated to protect the user from a frontal impact.

Any protective material absorbs only so much impact force by compression. When this compression force is exceeded, the material either reaches a density where it transmits the force without further absorption or the material is crushed, absorbing additional energy. Once the material is crushed it needs to be replaced. When the material is within a helmet or within a covering the crushed material is difficult to notice. Thus there is a risk that a helmet will be used despite the protective material being no longer able to efficiently absorb an impact.

Finally, as is well understood, when a larger and thicker impact absorbing pad or combination of pads is used, more time is taken for deceleration which reduces the impact force which is transferred to the user, minimizing potential traumatic injury. Methods of extending the deceleration time are needed.

The present invention addresses these concerns.

SUMMARY OF THE INVENTION

According to one embodiment of the present invention, an improved supplemental protective pad for a helmet is disclosed. The improved pad provides gentle deceleration with graded absorption of the impact force in contrast to an abrupt impact and deceleration which can damage a person's head and/or brain. In one embodiment, the pad includes a base portion which is mounted to the surface of a helmet shell. The pad is shaped to cover high risk, non-frontal impact areas such as the back of the head and adjacent the sides of the crown of the head. Extending outwardly from the pad are a plurality of compressible and crushable protrusions.

The protrusions can be configured in a variety of shapes, sizes and densities to absorb a predetermined amount of force. When the individual wearing the helmet is involved in an impact on one of the impact areas, the protrusions complement any interior cushioning to compressibly absorb the impact force. If the impact force exceeds a predetermined level, the protrusions absorb additional energy while being crushably deformed.

When the protective pad has been crushably deformed, preferably the crushed portion is visibly noticeable and the protective pad is replaced.

Accordingly, it is an object of the present invention to provide an improved supplemental pad for protective equipment, such as a sports helmet.

Further objects, features and advantages of the present invention shall become apparent from the detailed drawings and descriptions provided herein.

DESCRIPTION OF THE PREFERRED EMBODIMENTS

For the purposes of promoting an understanding of the principles of the invention, reference will now be made to the embodiments illustrated and specific language will be used to describe the same. It will nevertheless be understood that no limitation of the scope of the invention is thereby intended, such alterations, modifications, and further applications of the principles of the invention being contemplated as would normally occur to one skilled in the art to which the invention relates.

The present invention provides an improved protective pad which can be applied to the exterior of a helmet or other protective equipment, such as a football helmet or a hockey helmet. The protective pad provides gentle deceleration of the person's body portion for a period of time instead of a direct, abrupt deceleration. By gradually absorbing force, the time during which the impact occurs is lengthened, changing the acceleration rate and thereby lowering the impact force which is transmitted through the protective layer. This could also be referred to as graded absorption since successively higher levels of force are absorbed. In a low energy impact the protective pad is compressed until it reaches maximum compression. In a high energy impact which exceeds the maximum compression, additional energy is adsorbed by the pad as it is being crushed. If the pad is tapered, successively greater force resistance must be overcome to continue to crush the pad until total crushability is reached.

The impact force on a person's head can be measured according to a formula commonly called the Head Impact Criterion (HIC) which is calculated as a function of time and acceleration. The present invention is designed to lower the Head Impact Criterion (HIC) below a level of about 1,000 and more preferably lowers the HIC below about 700.

The protective pad is preferably removably mounted to the exterior of the sports helmet and sized and shaped to cover an impact area of concern. According to several preferred embodiments, the protective pad is applied over exterior non-frontal impact areas on the rear of the helmet and/or along the sides of the helmet adjacent the top or crown. One such impact area is at the inion, the name for the bony protuberance at the back of the head.

Figure 1:
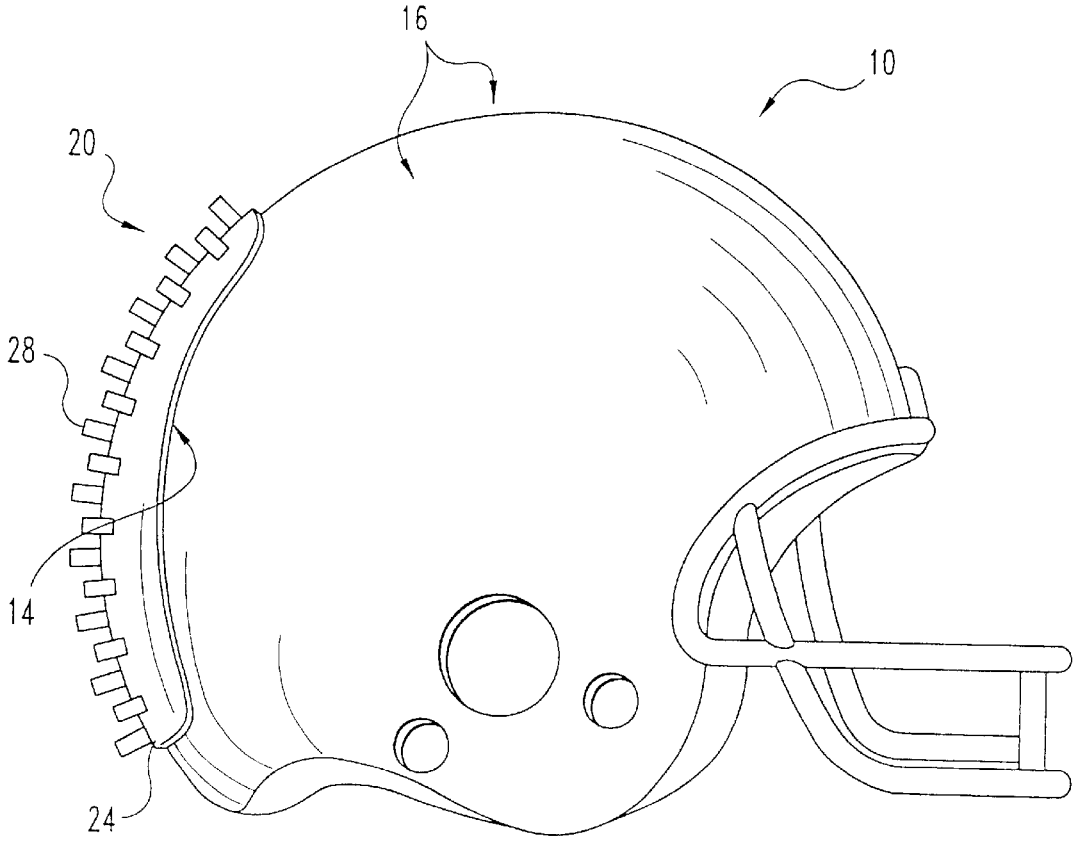
FIG. 1 is a side perspective view of one preferred embodiment of the present invention mounted on the back of a helmet.
Figure 2:
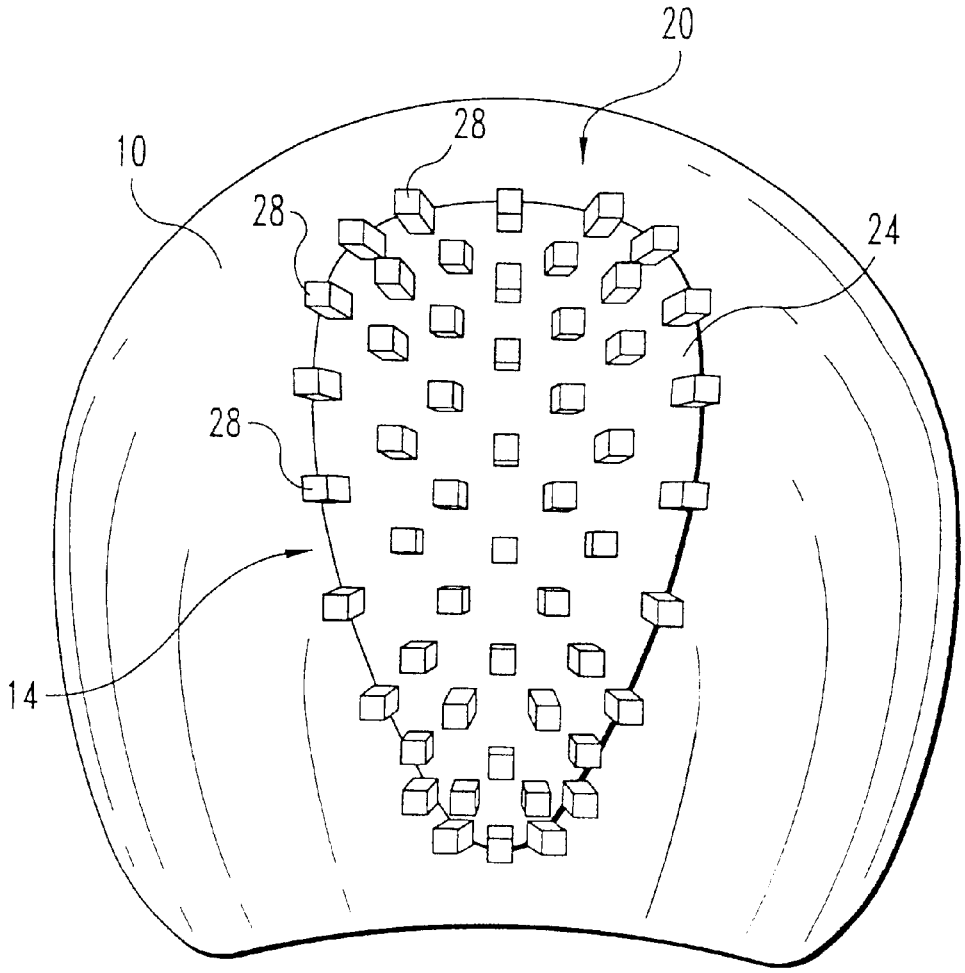
FIG. 2 is a rear view of the embodiment of the invention and helmet pictured in FIG. 1.

One preferred embodiment of the present invention is illustrated in FIGS. 1 and 2. The side and rear of a typical protective helmet or helmet shell 10 such as a football helmet is illustrated with protective pad 20. Pad 20 includes a rear portion 14 and side portions 16 adjacent the top of helmet 10. Protective pad 20 extends over rear area 14 and includes a base portion 24 from which a plurality of protrusions 28 extend.

Figure 3:
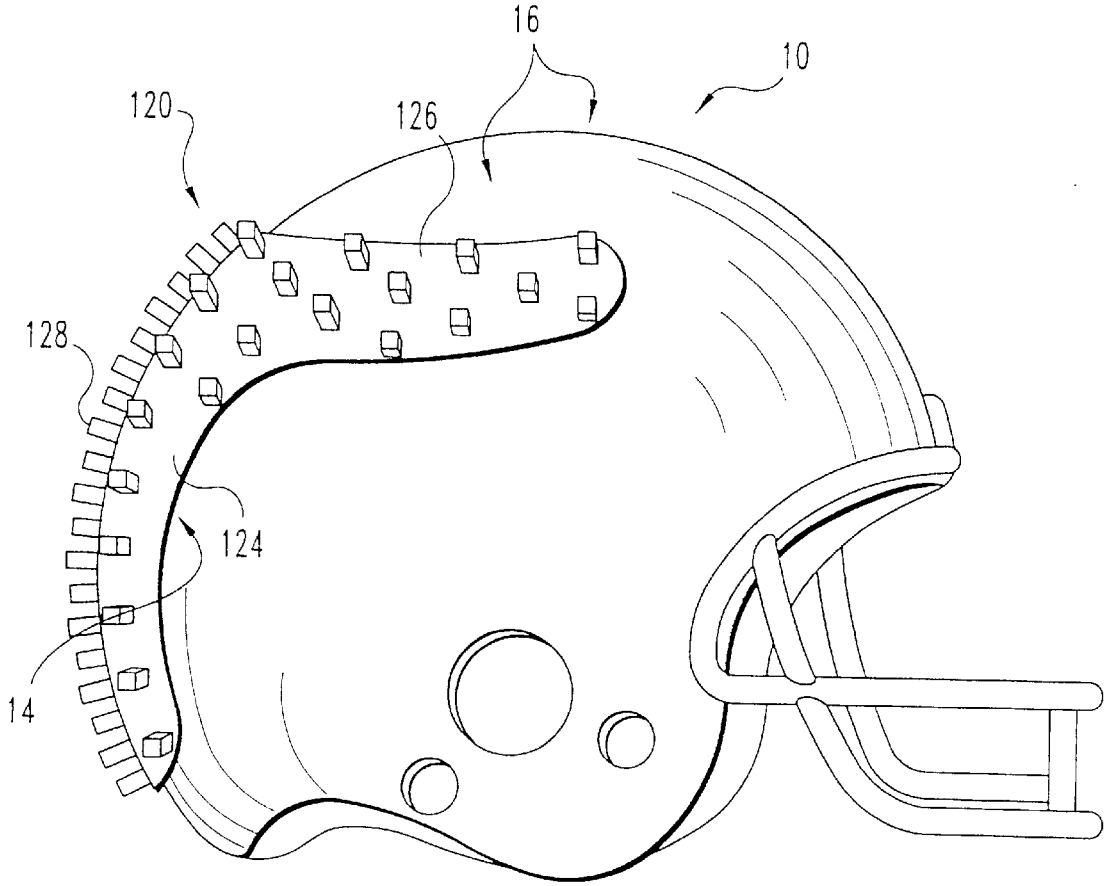
FIG. 3 is a side perspective view of an alternate preferred embodiment of the present invention mounted on a helmet.
Figure 4:
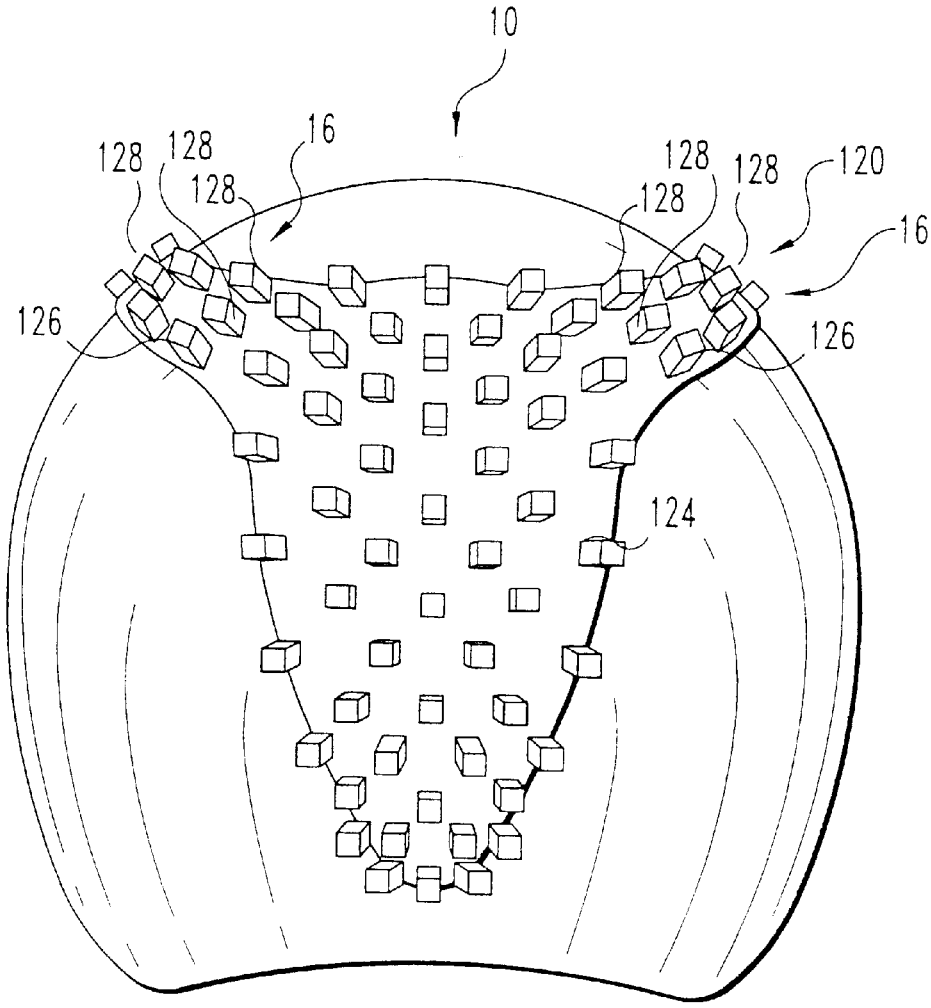
FIG. 4 is a rear perspective view of the preferred embodiment and helmet pictured in FIG. 3.

An alternate preferred embodiment is illustrated in FIGS. 3 and 4 with protective pad 120 applied to sports helmet 10. Protective pad 120 includes rear base portion 124 with protrusions 128 similar to protective pad 20, and further includes crown portions 126 with protrusions which extend from base portion 124 along the side areas 16 of sports helmet 10 adjacent to the crown.

In a further alternate embodiment (not pictured), the placement of the protrusions and base portion could be reversed. In this embodiment, the tips of the protrusions touch the helmet shell and the base portion is the exterior portion held away from the helmet. A traumatic impact against the base portion would compress the pad and then crush the protrusions between the base portion and the helmet shell. In another alternate embodiment, laminate layers of material with different compression/ crushability characteristics could be used with the outer layer(s) which have a lower crushability resistance functioning as the protrusions and the lower layer(s) with a higher crush resistance functioning as the base.

In a further, less preferred embodiment, the pad is mounted in the interior of the helmet shell and held between the helmet shell and the user's head. The protrusions and shape of the pad could be custom sized and shaped for an individual player while still being crushable and easily replaceable. An interior pad according to this embodiment could be used independently or in combination with an exterior pad in accordance with the present invention.

Figure 5:
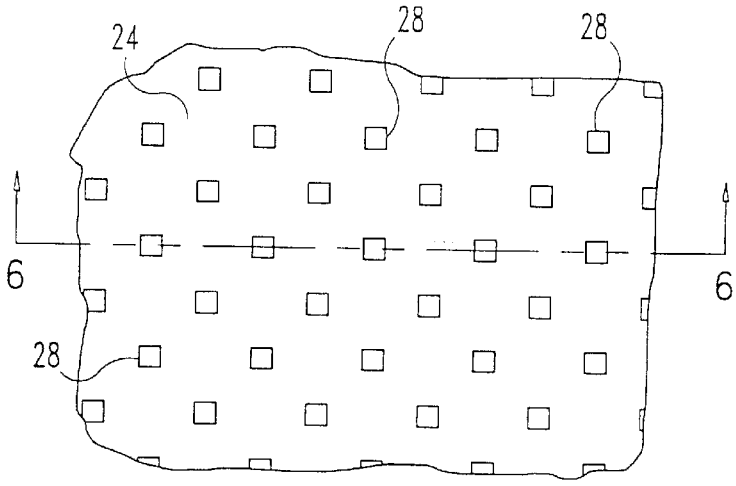
FIG. 5 is a top view of a portion of a pad and protrusions according to a preferred embodiment.
Figure 6:
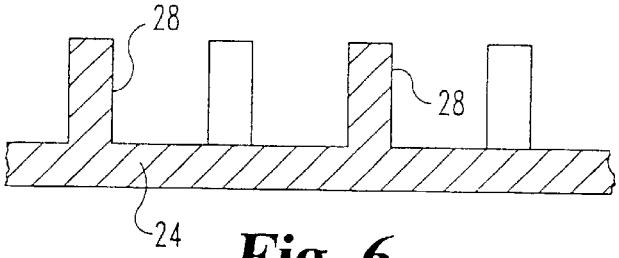
FIG. 6 and FIG. 7 illustrate alternate preferred embodiments with side views of the protrusions illustrated in FIG. 5.
Figure 7:
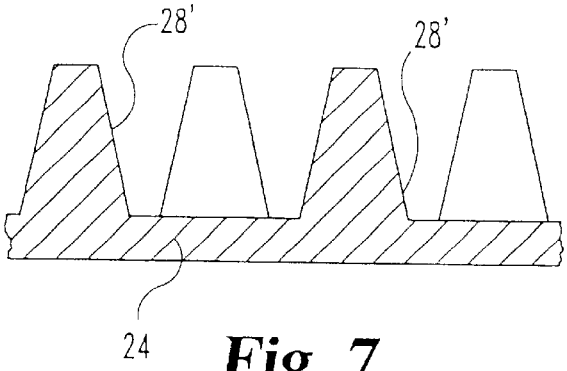

FIGS. 5–10 illustrate several preferred geometries for protrusions 28. As seen in FIG. 5, a top down view of a portion of base 24 is shown with a spaced pattern of protrusions 28. Cross sectional side views of protrusions 28 and 28' in a pincushion or porcupine like pattern are shown in FIGS. 6 and 7. FIG. 6 illustrates protrusions 28 with thin walls which compress and/or bend and then are crushably broken or deformed by a relatively light impact. Protrusions 28' illustrated in FIG. 7 have a wider base and tapered cross section as they extend. Protrusions 28' would crushably deform or break with relatively light force at the tips but increasing impact force would be absorbed as protrusions 28' are crushed or broken closer to their bases due to the widening cross section. Protrusions 28 and 28' can be arranged in parallel or staggered rows or other patterns on base portion 24.

Figure 8:
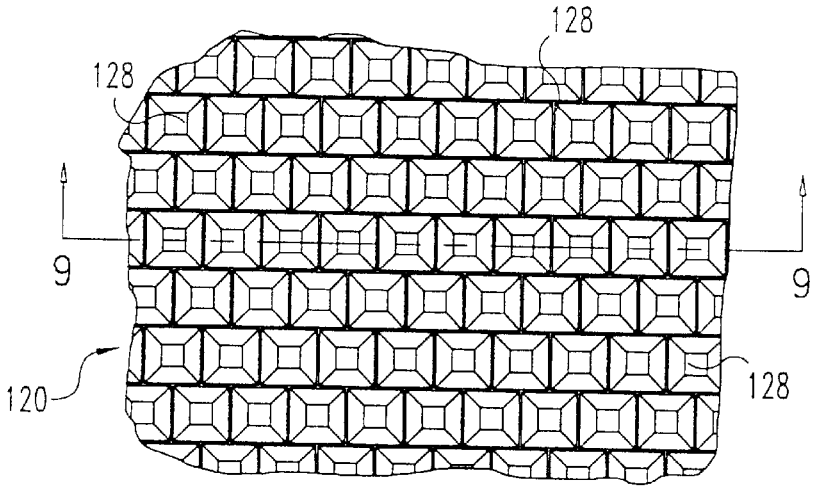
FIG. 8 illustrates an alternate preferred embodiment of a section of a pad with protrusions.
Figure 9:
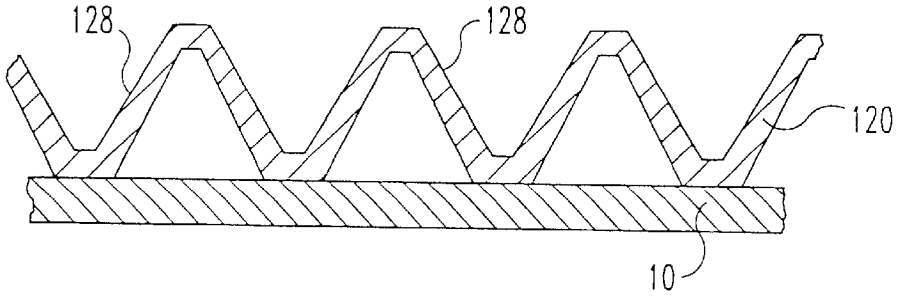
FIG. 9 and FIG. 10 illustrate alternate preferred embodiments with side views of the protrusions illustrated in FIG. 8.
Figure 10:
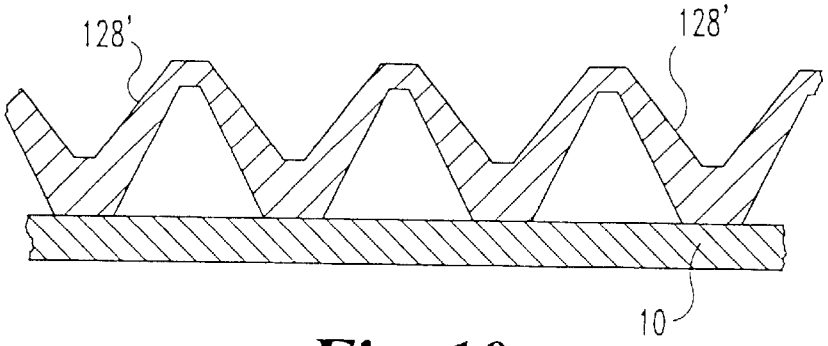

An alternate geometry for protrusions 28 is illustrated in FIGS. 8–10 with protrusions 128. In this embodiment, an egg crate carton or honeycomb design is used with alternating peaks and valleys forming alternate pad 120 including protrusions 128. As shown in FIG. 9, protective pad 120 is formed in an egg crate cross-section design with the peaks forming the protrusions 128 and the valleys forming the base in contact with helmet 10. Hollow areas remain between the peaks of protrusions 128 and the helmet 10 allowing room for compression and for the movement of pieces of protrusions 128 when the protrusions are crushably deformed. The egg crate or honeycomb protrusion pattern can have relatively thin walls/protrusions 128 or the relatively thicker walls/protrusions 128' shown in FIG. 10. The protrusion thickness and density is calculated to correspond to the desired amount of impact force to be absorbed.

In a preferred embodiment, pad 20 or 120 and protrusions 28 or 128 are integrally made from Styrofoam® multicellular material, a molded or extruded plastic foam, a molded sponge material or a similar material. The density and thickness of the base 24 and protrusions 28 can be designed and varied to compressibly and resiliently absorb a predetermined amount of impact force, normally referred to in terms of distance at a certain pressure and then be crushably deformed after the compressibility impact threshold is exceeded. In some designs, the compressibility of the foam can be varied as a function of the speed of impact such that a greater impact force is slowed over more time before the maximum compression is reached. Further, the specific foam and resistance can be custom chosen for the size of the player, level of play and the estimated maximum impact force.

By way of illustration, a Styrofoam® material can be used with a density of 0.02–0.025 grams per cubic centimeter. The compressibility of this example is 0.4 cm at 12,500 grams/cm$^2$. Alternate materials, such as compressible foam or rubber, cardboard or crushable metal may also be used when formed with the desired shape and compression/crushability characteristics.

Figure 11A:
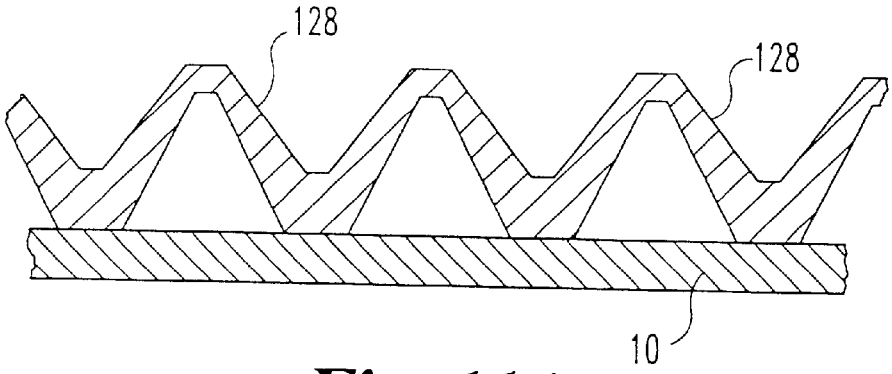
FIG. 11A illustrates a side view of one embodiment of the protrusions before use.
Figure 11B:
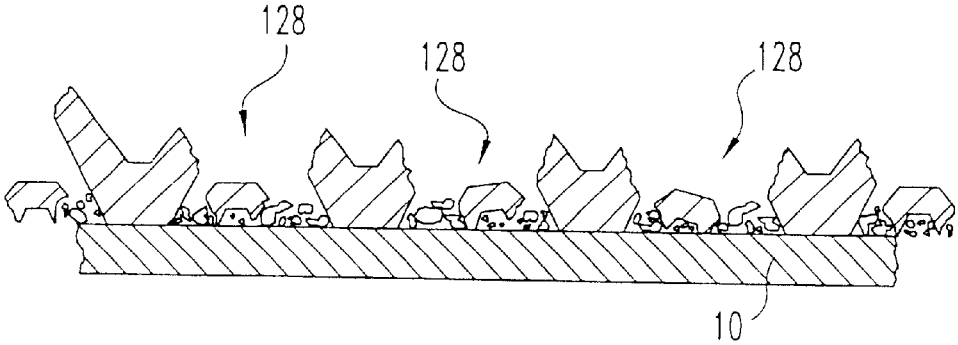
FIG. 11B illustrates a side view of the protrusions illustrated in FIG. 11A after the protrusions have been crushably deformed.

FIGS. 11A and 11B illustrate the crushability of protrusions 128 overlaid on helmet 10 before and after an impact. After an impact exceeds the compressible force level, protrusions 128 crushably deform so that the tips or peaks of protrusions 128 are visibly noticeable as broken. In extreme cases the entire pad and protrusions are crushably deformed by being broken in to various pieces.

Figure 12:
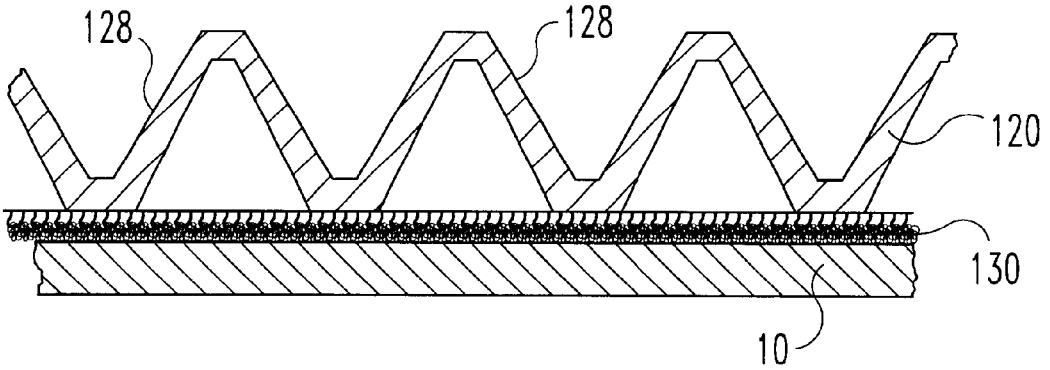
FIG. 12 illustrates an alternate preferred embodiment of the embodiment illustrated in FIG. 9.

When in use, protective pad 20 is applied to a helmet 10 and mounted over the impact zone of concern such as rear and side areas 14 and 16. Pad 20 is preferably removably mounted to helmet 10 using standard connection methods such as Velcro® hook and loop fasteners 130 (shown in FIG. 12), snaps, buttons or adhesive. Pad 20 can be decorated with color patterns, insignia or text to an appropriate team color or designation. The athlete then wears helmet 10 while involved in the athletic activity. If the athlete falls backwards or sideways and is in danger of hitting the helmet in an impact area of concern, such as through a football tackle or hockey checking, exterior protective pad 20 impacts the surface prior to the helmet. Protrusions 28 and pad 24 compressibly absorb an amount of impact force before protrusions 28 are broken. Additional impact force is absorbed by the breaking material. This impact force absorption functions in addition to and complimentary to the protection provided by the helmet shell and any padding within it.

To be easily usable while not interfering with a person's activity, the supplemental pad is sized to not interfere with normal movements of the person's head and to not interfere with the field of view. Additionally, the pad is preferably lightweight to avoid causing excess burden to the user. It is also preferred that the pad be made from an inexpensive material so that users are willing and able to replace a broken pad without concern for cost.

After protrusions 28 or 128 are broken or crushed, it is preferably visibly noticeable to observers. The broken or crushed protrusions can be noticed by the physical difference or a contrasting color in or under the pad which is made visible when the protrusions are crushed. Supplemental pad 20 can then be removed from helmet 10 and a replacement pad fastened in place. As a further option a nylon mesh, net or cover can be attached over the pad to prevent debris from a crushed pad from falling on the playing surface and potentially interfering with others. The present invention provides a one use, replaceable, low cost supplemental pad for protecting a user from impact trauma in addition to a standard helmet.

Although the present invention was designed with specific consideration to sports helmets, such as for football, hockey, rollerblading or bicycling, it will be understood that the invention is usably with a variety of protective headwear such as motorcycle helmets, construction helmets or caving helmets. Moreover, the supplemental pad can be used with protective gear on other portions of a person's body such as the hips, legs, knees, elbows, arms or back to provide additional impact absorption in case of a potentially traumatic impact.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A protective pad for a sports helmet, comprising:

a) a base mountable to a helmet over a predetermined impact area; and b) a plurality of protrusions extending from said base;

c) wherein said protrusions and base are made from a compressible force absorbing material; and, d) wherein said plurality of protrusions are configured to be deformed by crushing when subjected to an impact force greater than a predetermined level.

2. The protective pad of claim 1 wherein said base is shaped to cover an impact area at the rear of the sports helmet.

3. The protective pad of claim 2 wherein said base further comprises side portions shaped to extend over impact areas on the sides of the sports helmet adjacent the crown.

4. The protective pad of claim 2 wherein said base is removably mounted to the sports helmet.

5. The protective pad of claim 2 wherein said base and protrusions are configured to reduce the Head Injury Criterion below a value of about 1000.

6. The protective pad of claim 5 wherein said base and protrusions are configured to reduce the Head Injury Criterion below a value of about 700.

7. The protective pad of claim 4 wherein said base is removably mounted to the sports helmet with hook-and-loop fasteners.

8. The protective pad of claim 4 wherein said protrusions are arranged in rows.

9. The protective pad of claim 4 wherein said base and said protrusions have an egg-crate pattern of peaks and valleys.

10. The protective pad of claim 4 wherein said protrusions have a uniform cross-section.

11. The protective pad of claim 4 wherein the cross-section of said protrusions is tapered to a reduced cross-section at the tips.

12. The protective pad of claim 4 wherein it is visually apparent when said protrusions have been deformed by crushing.

13. A protective pad for a piece of sporting equipment, comprising:

a) a base mountable to the piece of sporting equipment over a predetermined impact area; and b) a plurality of protrusions extending from said base;

c) wherein said protrusions and base are made from a compressible force absorbing material; and, d) wherein said plurality of protrusions are configured to be deformed by crushing when subjected to an impact force greater than a predetermined level.

14. The protective pad of claim 13 wherein said base is removably mounted to the piece of sporting equipment.

15. The protective pad of claim 14 wherein said base is removably mounted to the piece of sporting equipment with hook-and-loop fasteners.

16. The protective pad of claim 15 wherein said protrusions have a uniform cross-section.

17. The protective pad of claim 15 wherein the cross-section of said protrusions is tapered to a reduced cross-section at the tips.

18. A method of using a supplemental protective pad for a sports helmet, comprising the steps of:

a) removably mounting a protective pad to a sports helmet over a predetermined impact area, wherein said pad includes a plurality of protrusions extending from a base and wherein said plurality of protrusions are deformed by crushing when subjected to an impact force greater than a predetermined level;

b) observing when at least one of said protrusions has been deformed by crushing by an impact; and, c) replacing said protective pad after at least one of said protrusions has been deformed by crushing.

19. A protective helmet for a person's head, comprising:

a) a helmet shell for extending substantially around the person's head;

b) an exterior protective pad mounted to said helmet shell over a predetermined impact area; and, c) a plurality of protrusions extending from said exterior protective pad, wherein said plurality of protrusions are deformed by crushing when subjected to an impact force greater than a predetermined level.

20. The protective helmet of claim 19 further comprising an interior pad attached to said helmet shell and mounted between said helmet shell and the person's head.

* * * * *

UNITED STATES PATENT AND TRADEMARK OFFICE

CERTIFICATE OF CORRECTION

PATENT NO. : 6,314,586 B1
DATED : November 13, 2001
INVENTOR(S) : Duguid et al.

It is certified that error appears in the above-identified patent and that said Letters Patent is hereby corrected as shown below:

Title page,
Item [76], Inventors: please add -- James R. Duguid, 9610 N. CR 1025 East Browsburg, IN (US) 46112 --

Signed and Sealed this

Eleventh Day of June, 2002

*Attest:*

*Attesting Officer*

JAMES E. ROGAN
*Director of the United States Patent and Trademark Office*